United States Patent [19]

Carpenter, Jr. et al.

[11] Patent Number: 4,697,391

[45] Date of Patent: Oct. 6, 1987

[54] VANE RETENTION APPARATUS FOR ABRASIVE BLASTING MACHINE

[76] Inventors: James H. Carpenter, Jr., 212 Pangborn Blvd.; Kenneth R. Peters, 215 Greenhill Dr., both of Hagerstown, Md. 21740

[21] Appl. No.: 811,749

[22] Filed: Dec. 20, 1985

[51] Int. Cl.[4] ..... B24C 5/06

[52] U.S. Cl. ..... 51/434; 51/435

[58] Field of Search ..... 51/434, 435, 432

[56] References Cited

U.S. PATENT DOCUMENTS 3,383,804 5/1968 Haider ..... 51/434

4,402,163 9/1983 Carpenter et al. ..... 51/434

*Primary Examiner*—Frederick R. Schmidt

*Assistant Examiner*—Bradley I. Vaught

*Attorney, Agent, or Firm*—Wayne D. Porter, Jr.

[57] ABSTRACT

Apparatus for retaining vanes in an abrasive blasting machine includes a rotatable runnerhead having a radially extending channel opening through one face of the runnerhead. A slot is included as part of the channel adjacent the radially outer end of the channel. A vane includes a base adapted to be disposed within the channel and retained there by a retaining pin fitted into the slot. A magnet is disposed in the slot in order to retain the pin in the slot at all times. The base includes a plurality of intersecting planar surfaces overlying the slot that cooperate to (1) enable the pin to be inserted and removed without displacing other machine components and (2) hold the pin securely in place during operation of the machine. The planar surfaces are configured such that the vane can be manufactured in a casting operation without using cores, thereby effecting significant cost savings.

16 Claims, 11 Drawing Figures

VANE RETENTION APPARATUS FOR ABRASIVE BLASTING MACHINE

BACKGROUND OF THE INVENTION

1. Field of the Invention

The invention relates to abrasive blasting machines of the type having a runnerhead to which a plurality of radially extending vanes are secured and, more particularly, to a technique for locking the vanes to the runnerhead.

2. Description of the Prior Art

In abrasive blasting machines of the type having a runnerhead to which a plurality of radially extending vanes are secured, it is important to be able to retain the vanes in place under all operating conditions while, at the same time, being able to remove and replace worn or broken vanes with minimal effort. Prior techniques for retaining vanes in the runnerhead have presented various difficulties. For example, vanes have been secured to a runnerhead by bolting the vanes to the runnerhead. This technique makes the vane replacement process time-consuming, and it requires that threaded openings be formed in the runnerhead. In another construction, double runnerheads are provided and the vanes are slid into slots in the double runnerheads from the center of the wheel. The vanes are held in place by a spacer bar which extends between, and supports, the runnerheads. This arrangement requires removal of all feed parts as well as removal of the vanes through the centrally disposed feed spout opening.

Another technique is shown by U.S. Pat. No. 3,383,804, to J. V. Haider. In the U.S. Pat. No. 3,383,804 patent, the vanes are slid into radially extending channels from the periphery of the runnerhead and moved to an extreme innermost position. Retainer pins then are fitted into openings formed in the outer portion of the runnerhead. The retainer pins are disposed perpendicular to the face of the runnerhead. Thereafter, the vanes are slid radially outwardly until the pins are contacted. A locking ring is attached to the center of the runnerhead in order to prevent the vanes from moving radially inwardly so as to possibly free the retainer pins. The retainer pins also are secured in place within the openings in the runnerhead by means of magnets glued in place in the openings. Although this approach is reasonably effective, it requires that the locking ring be removed in order for any given vane to be replaced. Unfortunately, when the locking ring is removed, all of the vanes are freed for movement, thereby making the vane replacement process more difficult. Additionally, the openings formed in the runnerhead for receiving the pins and magnets are quite deep, making the runnerhead manufacturing process more difficult.

U.S. Pat. Nos. 4,402,163; 4,471,583; and 4,509,300, to J. H. Carpenter et al. (hereafter referred to as the Vane Retention Patents), the disclosures of which are incorporated herein by reference, disclose vane retention techniques that overcome most of the objections noted earlier. In the Vane Retention Patents, the runnerhead is provided with a relatively small well, or slot, in each of the channels in which vanes are disposed. The slots are located quite close to the periphery of the runnerhead such that the slots are accessible from the periphery of the runnerhead. The base of the vanes is configured such that a retaining pin can be fitted into the slot in the runnerhead and held in place there upon radially outward movement of the vanes. In order to remove the retaining pin, the vanes are moved radially inwardly a small amount, whereupon the pin can be tilted about 20 degrees and pulled from the slot. This technique makes it easy to replace worn or broken vanes.

Despite the advances made by the Vane Retention Patents, certain problems have not been addressed. That portion of the base of the vane that engages the retianing pin has to be made to close tolerances, or the pin can rotate sidewise and come out of the slot into which it was inserted. Additionally, if the installer does not pull the vanes radially outwardly as part of the installation process, the pin may rotate sidewise and come out of its slot. In order to provide the required dimensional accuracy for the vane base, the casting process used to manufacture the vanes is made more difficult. Specifically, it is necessary to use cores (usually ceramic cores) to manufacture the vanes, and the use of such cores increases the cost of manufacturing the vanes. The use of cores also reduces the number of vane impressions that can be put on a pattern board. For example, with cores, a typical pattern board can hold twelve impressions, whereas without cores, fifteen impressions can be held. Because thousands of vanes are manufactured yearly, the use of cores is an important factor in the cost of manufacturing the vanes.

SUMMARY OF THE INVENTION

The present invention provides a new and improved vane retention apparatus for abrasive blasting machines that overcomes the foregoing and other problems of prior art constructions. The invention employs certain of the components disclosed in the Vane Retention Patents, including a rotatable runnerhead having radially extending channels opening through one face of the runnerhead. A slot is included as part of each channel adjacent the radially outer end of the channels. Each channel carries a vane having a blade and a base along one edge of the blade. The base is adapted to be fitted into the channel such that the vane is secured to the runnerhead. A retaining pin is adapted to be fitted into the slot and into engagement with the base of the vane in order to prevent the vane from being displaced radially outwardly of the runnerhead.

In the present invention, a first, planar surface defining a ramp extends into the base near the radially outer end of the vane. A second, planar surface defining a back wall intersects the first planar surface. The second planar surface is disposed generally parallel to the face of the base and is spaced from the face. A side wall is disposed along one side of the first planar surface. The side wall includes a third, planar sloping surface that is inclined at about a 45 degree angle relative to the longitudinal axis of the vane, and a fourth, planar surface alinged with the longitudinal axis of the vane. The side wall guides the retaining pin into the slot and aligns the pin with the longitudinal axis of the vane.

The blade extends generally perpendicular to the base in lateral alignment with the second planar surface. The edge of the blade closest to the side wall is beveled so that a relatively large retaining pin can be fitted into the slot. In the preferred embodiment, the first, planar surface extends into the base at an angle of about 30 degrees relative to a plane in which the face of the base lies and the third, planar surface is inclined at an angle of about 45 degrees relative to the longitudinal axis of the vane.

In order to retain the pin in the slot, a magnet is disposed in the bottom wall of the slot. In the preferred embodiment, a non-magnetic sleeve made of a material such as heat-resistant rubber surrounds the magnet and holds it in place in the slot.

The invention prevents the retaining pin from rotating after proper insertion and falling out of the slot in which it was initially inserted. The magnet ensures that the retaining pin will be held in a longitudinal position even if the installer does not pull the vane to a radially outermost position as part of the installation process. Additionally, the particular construction of the vane permits vanes to be manufactured to acceptable tolerances without the use of cores, thus effecting a considerable cost savings in the casting process by which the vanes are manufactured. The foregoing, and other features and advantages of the invention, will be apparent from reviewing the accompanying drawings and the following specification and claims.

DESCRIPTION OF THE PREFERRED EMBODIMENT

Figure 1:
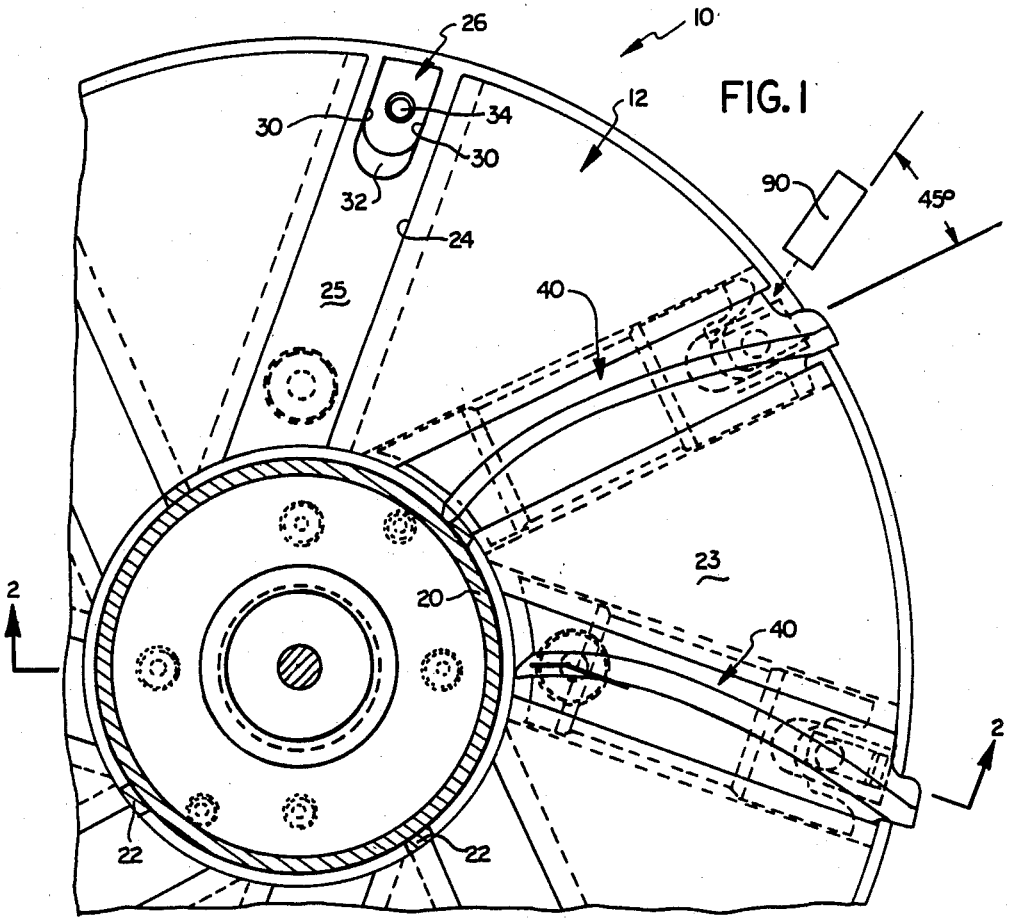
FIG. 1 is a side elevational view of the portion of the runnerhead of an abrasive blasting machine showing one vane in place and a second vane in the process of being locked in place, the view being taken along a plane indicated by line 1—1 in FIG. 2.
Figure 2:
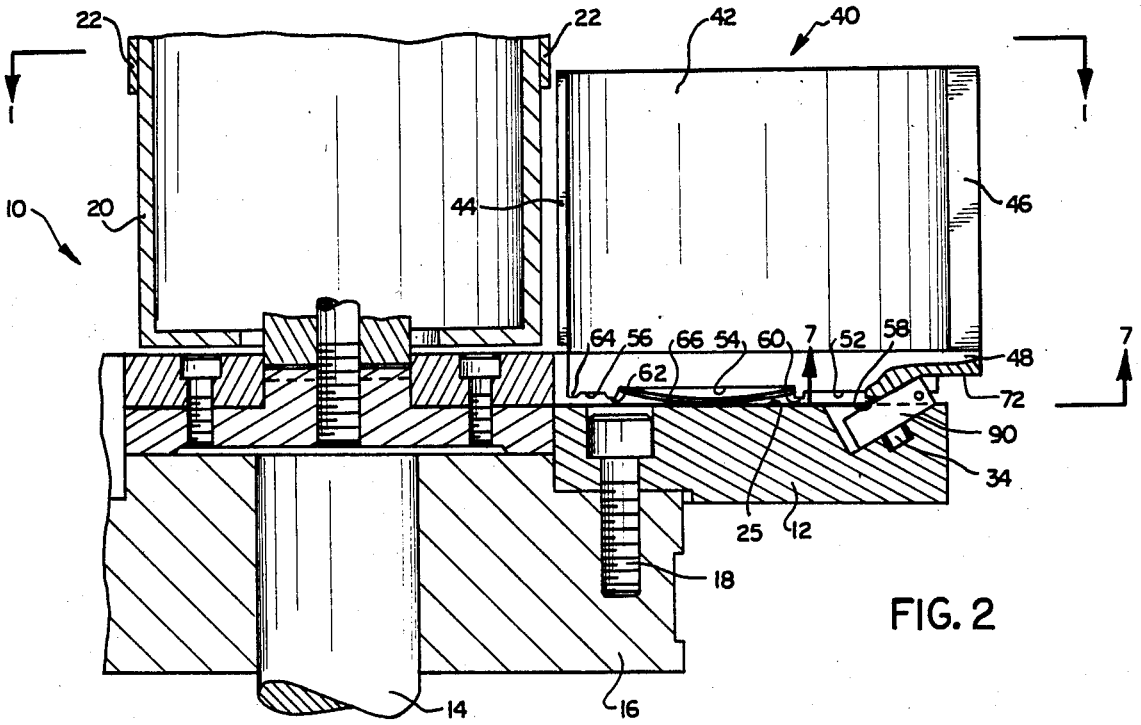
FIG. 2 is a cross-sectional view of the runnerhead of FIG. 1 taken along a plane indicated by line 2—2 in FIG. 1.
Figure 3:
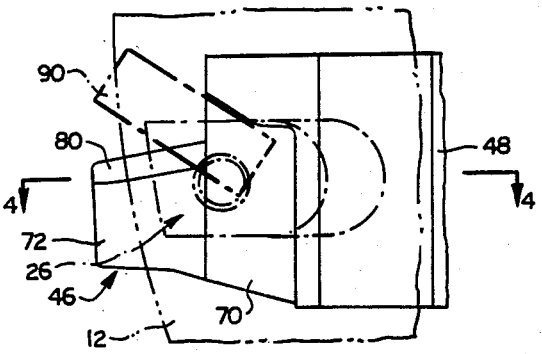
FIG. 3 is an enlarged fragmentary sectional view of the outer portion of the back face of one of the vanes of FIG. 1, showing the runnerhead and a pin slot in phantom and a retaining pin in position for insertion.
Figure 4:
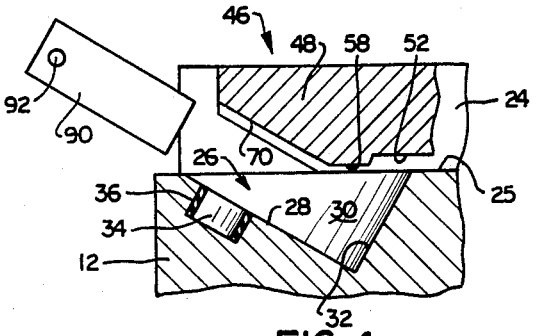
FIG. 4 is a cross-sectional view taken along a plane indicated by line 4—4 in FIG. 3.
Figure 5:
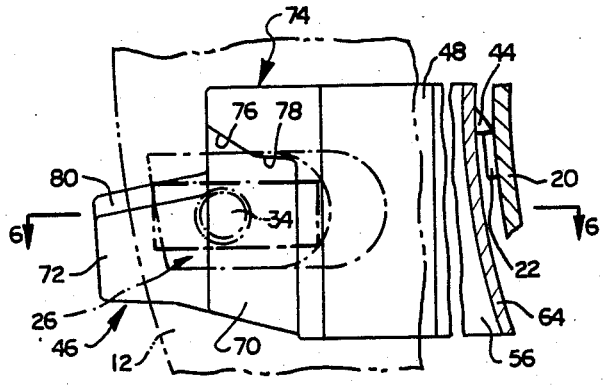
FIG. 5 is a view similar to FIG. 3 showing the vane in a radially innermost position and the retaining pin inserted into the pin slot.
Figure 6:
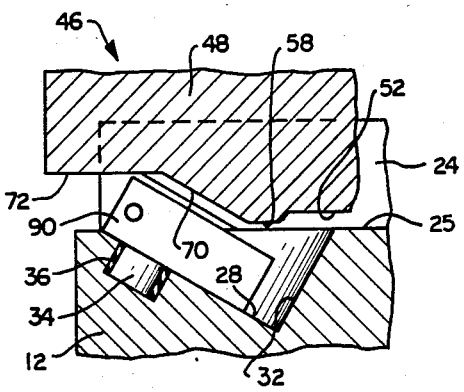
FIG. 6 is a cross-sectional view taken along a plane indicated by line 6—6 of FIG. 5.
Figure 7:
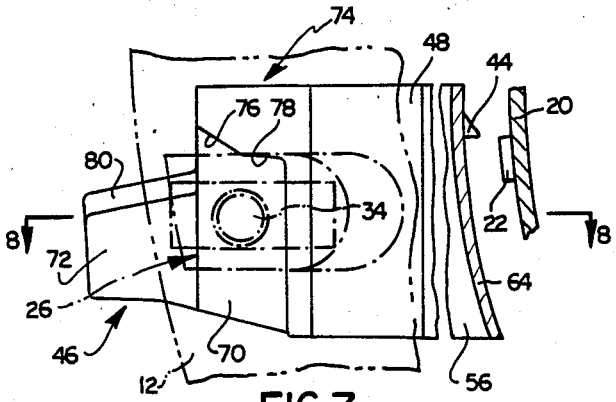
FIG. 7 is a view similar to FIG. 5 taken along a plane indicated by line 7—7 in FIG. 2 showing the vane in a radially outermost position and locked in place by the retaining pin.
Figure 8:
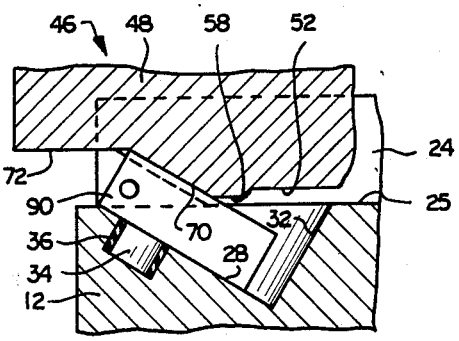
FIG. 8 is a cross-sectional view taken along a plane indicated by line 8—8 in FIG. 7.
Figure 9:
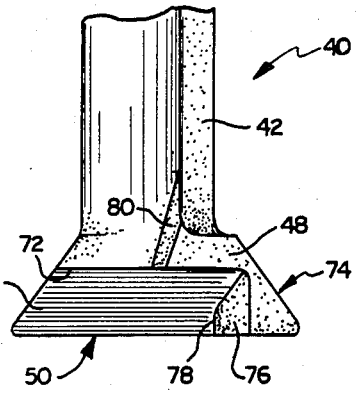
FIG. 9 is an end elevational view of a portion of one of the vanes of FIG. 1.
Figure 11:
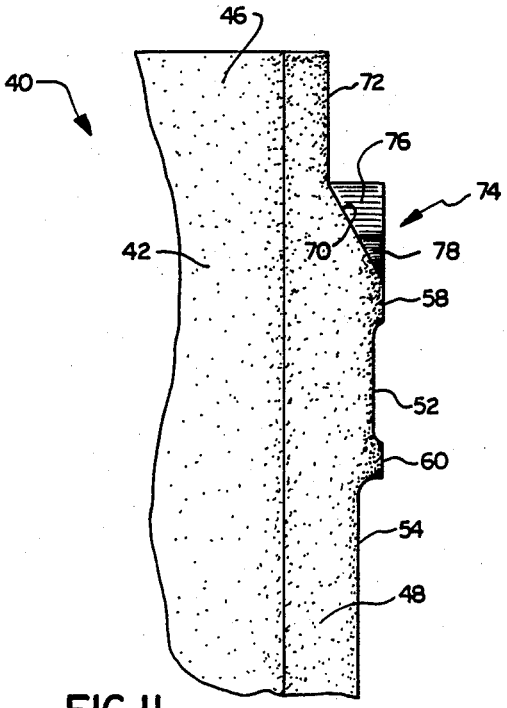
FIG. 11 is a front elevational view of a portion of the vane illustrated in FIG. 9.
Figure 10:
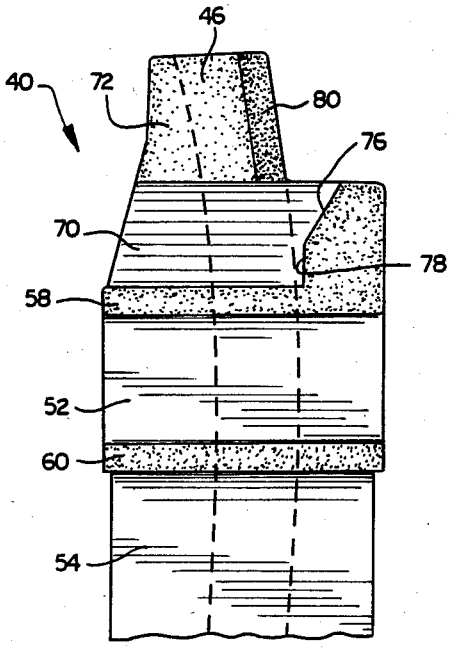
FIG. 10 is a side elevational view of a portion of the vane illustrated in FIG. 9 showing the face of the vane base.

Referring particularly to FIGS. 1 and 2, an abrasive blasting machine is referred to generally by the reference numeral 10. The machine 10 includes a disk-like runnerhead 12 supported for rotation by a shaft 14. The runnerhead 12 is connected to the shaft 14 by a hub 16 and bolted fasteners 18. An impeller case 20 is concentrically aligned with the shaft 14 at a radially innermost position of the runnerhead 12. The impeller case 20 is maintained in a stationary position relative to the runnerhead 12. The impeller case 20 includes a plurality of circumferentially disposed lugs 22.

The runnerhead 12 includes a face 23 and a plurality of generally radially extending slots, or channels 24 opening through the face 23. The channels 24 are undercut in the manner of a dovetail and include a floor 25. The channels 24 define a longitudinal axis, which axis is disposed at an angle to radial lines emanating from the center of the runnerhead 12.

Each of the channels 24 includes a well, or slot 26 disposed near its outer end. Each slot 26 includes a planar bottom wall 28, planar side walls 30, and a rounded end wall 32 connecting the side walls 30. Referring particularly to FIGS. 2, 4, 6 and 8, the slot 26 opens through the floor 25. The slot 26 has a zero depth in the floor 25 at the radially outermost location of the planar bottom wall 28, and increases to its greatest depth at the intersection between the bottom wall 28 and the end wall 32. The planar bottom wall 28 extends into the floor 25 at an angle of approximately 30 degrees measured from the plane in which the floor 25 lies.

A magnet is disposed within, and forms a portion of, the bottom wall 28. The magnet 34 is surrounded by a sleeve 36 which holds the magnet 34 in place. The sleeve 36 is made of non-magnetic material such as heat-resistant rubber, epoxy, or aluminum.

A plurality of vanes 40 are provided for the machine 10, each of the vanes 40 being supported by the runnerhead 12 and adapted to receive abrasive material fed through the impeller case 20. Upon rotation of the runnerhead 12 and upon feeding abrasive material through the impeller case 20, the vanes 40 will receive the abrasive material and throw it outwardly at high speed. The abrasive material thus thrown can be used for a variety of purposes such as cleaning metal parts to remove rust and scale. The general operation of the machine 10 for such purposes is well known to those skilled in the art, and further discussion here is unnecessary.

Each of the vanes 40 includes a blade 42 curved in the direction of rotation of the runnerhead 12. In the embodiment illustrated in FIG. 1, the runnerhead 12 is adapted to be rotated clockwise. Each of the blades 42 includes an inner end 44 which receives abrasive material, and an outer end 46 which discharges abrasive material. A more detailed description of the blade portion of the vane 40 can be had by referring to U.S. Pat. No. 3,872,624 to Ramaswamy, the disclosure of which is incorporated herein by reference. Vanes manufactured pursuant to the U.S. Pat. No. 3,872,624 patent are commercially available from the Pangborn Company, Hagerstown, Md., under the trademark CURVANE®.

Each of the vanes 40 includes an elongate base 48 extending along one side of the blade 42. The base 48 is adapted to be received within the channel 24 such that the blade 42 is disposed generally perpendicular to the face 23. The base 48 includes a face 50 disposed opposite the blade 42. The face 50 includes a plurality of laterally extending grooves 52, 54, 56 spaced along the length of the base 48. A plurality of support surfaces 58, 60, 62, 64 occupy those portions of the base 48 intermediate the grooves 52, 54, 56. The surfaces 58, 60, 62, 64 lie in a common plane which defines the face 50. A leaf spring 66 is disposed in the groove 54. As can be seen in FIG. 2, the leaf spring 66 will bear against the floor 25 and cam the base 48 away from the floor 25 so as to seat the base 48 firmly in the channel 24.

Referring particularly to FIGS. 3–11, the outer end of the vane 40 includes a first, planar surface 70 defining a ramp extending into the face 50. The ramp 70 extends into the face 50 at an angle of approximately 30 degrees measured from the plane in which the face 50 lies. A second, planar surface 72 defining a back wall intersects the ramp 70. The wall 72 is disposed parallel to the face 50 and is spaced from the face 50 a short distance. A side wall 74 is disposed at one side of the surfaces 70, 72. The side wall 74 includes a third, planar surface 76 and a fourth, planar surface 78. The surface 76 is perpendicular to the face 50, and is inclined at an angle of approximately 45 degrees from the longitudinal axis of the vane 40. The surface 78 also is disposed perpendicular to the face 50, and lies in a plane parallel to the longitudinal axis of the vane 40. The surface 72 is positioned laterally such that the back wall 72 forms a portion of the outer end 46 of the blade 42. That portion of the outer end 46 closest to the side wall 74 is beveled as indicated by the reference numeral 80.

A retaining pin 90 is provided to lock each vane 40 in place relative to the runnerhead 12. The retaining pin 90 is an elongate metal member having a rectangular cross-section. The pin 90 includes a pair of laterally extending passages 92 adapted to receive a suitable hook-like removal tool. The pin 90 is substantially identical to the retaining pins disclosed in the Vane Retention Patents.

ASSEMBLY AND OPERATION

In order to assemble and operate the machine 10, the following steps are taken:

1. The vanes 40 are inserted, one at a time, into their respective channels 24 and moved radially inwardly to that position shown in FIGS. 3 and 4. The inner end 44 will engage the impeller case 20 and limit radially inward movement of the vane 40. In this position, the ramp 70, back wall 72, and side wall 74 are disposed in opposed relationship to the slot 26.

2. The retaining pin 90 is inserted into the slot 26 by positioning one side of the pin 90 against the surface 76 and pushing the pin 90 toward the end wall 32. The ramp 70 assists in guiding the pin 90 into the slot 26. The beveled portion 80 enables a relatively large pin 90 to be inserted into the slot 26 without reducing the thickness of the blade 42 at the outer end 46.

3. The pin 90 is aligned with the longitudinal axis of the vane 40 atop the magnet 34. The surface 78 assists in aligning the pin 90 with the longitudinal axis of the vane 40. Due to the magnetic action of the magnet 34, the pin 90 will be held in its longitudinally aligned position, even after the installer releases a grip on the pin 90.

4. The vane 40 is moved radially outwardly to that position shown in FIGS. 7 and 8. In this position, the inner end 44 is released from the lug 22, and the ramp 70 engages the side of the pin 90 in surface-to-surface contact. Because the bottom wall 28 and the ramp 70 are parallel to each other, the pin 90 is tightly clamped. Additionally, the back wall 72 serves to prevent the pin 90 from being removed endwise from the slot 26.

5. Removal of the vane 40 is effected by reversing the foregoing steps.

The particular construction of the slot 26, the base 48, and the pin 90, in conjunction with the magnet 34, enable the vanes 40 to be securely held in place in the runnerhead 12 while permitting the vanes 40 to be removed and replaced individually. The vane removal process can be carried out without removing any components except the pin 90, and this can be accomplished by having access only to the periphery of the runnerhead 12. Not only does the present invention provide an exceedingly effective vane retention technique, but it also enables the vanes 40 to be manufactured at less expensive than prior vanes. The planar nature of the surfaces 70, 72, and the use of only one side wall 74, enable the vanes 40 to be manufactured to acceptable tolerances without the use of cores. Accordingly, the expense of the cores is eliminated, the effort needed to handle the cores is avoided, and more vanes can be made with a given pattern board than could be made previously. By use of the present invention, significant cost savings can be realized.

Although the invention has been described in its preferred form with a certain degree of particularity, it will be understood that the present disclosure of the preferred embodiment has been made only by way of example and that various changes in the details of construction and the combination and arrangement of parts may be resorted to without departing from the true spirit and scope of the invention as hereinafter claimed. It is intended that the patent shall cover, by suitable expression in the appended claims, whatever features of patentable novelty exist in the invention disclosed.

What is claimed is:

1. A vane for use in an abrasive blasting machine having a rotatable runnerhead, a radially extending channel in the runnerhead opening through one face of the runnerhead, a slot included as part of the channel adjacent the radially outer end of the channel, and a retaining pin adapted to be fitted into the slot, the vane comprising:

a blade disposed generally perpendicular to the face of the runnerhead; and a base disposed along one edge of the blade, the base being configured to be fitted into the channel such that the vane is secured to the runnerhead, the base defining a face opposed to the blade, the opposed face having a radially inner end and a radially outer end spaced along the length of the blade, the base defining a portion of a pin-receiving recess at the radially outer end of the opposed face, the outer end of the face including:

a first, planar surface extending into the opposed face;

a second, planar surface intersecting the first planar surface, the second planar surface being disposed generally parallel to the opposed face and spaced a short distance from the opposed face; and a single side wall disposed along one side of the first planar surface, the first planar surface being open along an opposite side, the side wall guiding the retaining pin into the slot and aligning the pin with the longitudinal axis of the vane.

2. The vane of claim 1, wherein:

the blade extends generally perpendicular to the base in alignment with the second planar surface; and the edge of the blade disposed closest to the side wall includes a beveled portion.

3. The vane of claim 1, wherein the side wall includes a third, planar surface inclined at an angle relative to the longitudinal axis of the vane, the side wall also including a fourth, planar surface disposed parallel to the longitudinal axis of the vane.

4. The vane of claim 3, wherein the third planar surface is inclined relative to the longitudinal axis of the vane at about a 45 degree angle.

5. The vane of claim 1, wherein the first planar surface extends into the opposed face at about a 30 degree angle measured from the plane in which the opposed face lies.

6. The vane of claim 1, wherein the runnerhead further includes a magnet disposed in the slot.

7. The vane of claim 6, further including a non-magnetic sleeve disposed about the magnet.

8. The vane of claim 7, wherein the sleeve is formed of heat-resistant rubber.

9. An abrasive blasting machine, comprising:

a rotatable runnerhead having a radially exending channel opening through one face of the runnerhead and a slot included as part of the channel adjacent the radially outer end of the channel;

a retaining pin adapted to be fitted into the slot;

a vane, the vane including a blade disposed generally perpendicular to the face of the runnerhead; and a base disposed along one edge of the blade, the base being configured to be fitted into the channel such that the vane is secured to the runnerhead, the base defining a face opposed to the blade, the opposed face having a radially inner end and a radially outer end spaced along the length of the blade, the base defining a portion of a pin-receiving recess at the radially outer end of the opposed face, the outer end of the face including:

first, planar surface extending into the opposed face;

a second, planar surface intersecting the first planar surface, the second planar surface being disposed generally parallel to the opposed face and spaced a short distance from the opposed face; and a single side wall disposed along one side of the first planar surface the first planar surface being open along an opposite side, the side wall guiding the retaining pin into the slot and aligning the pin with the longitudinal axis of the vane.

10. The abrasive blasting machine of claim 9, wherein:

the blade extends generally perpendicular to the base in alignment with the second planar surface; and the edge of the blade disposed closest to the side wall includes a beveled portion.

11. The abrasive blasting machine of claim 9, wherein the side wall includes a third, planar surface inclined at an angle relative to the longitudinal axis of the vane, the side wall also including a fourth, planar surface disposed parallel to the longitudinal axis of the vane.

12. The abrasive blasting machine of claim 11, wherein the third planar surface is inclined relative to the longitudinal axis of the vane at about a 45 degree angle.

13. The abrasive blasting machine of claim 9, wherein the first planar surface extends into the opposed face at about a 30 degree angle measured from the plane in which the opposed face lies.

14. The abrasive blasting machine of claim 9, further including a magnet disposed in the slot.

15. The abrasive blasting machine of claim 14, further including a non-magnetic sleeve disposed about the magnet.

16. The abrasive blasting machine of claim 15, wherein the sleeve is formed of heat-resistant rubber.

* * * * *